United States Patent [19]

Maruyama et al.

[11] 4,384,441

[45] May 24, 1983

[54] MACHINE FOR WRAPPING ELONGATED ARTICLES IN PLASTIC FILM

[75] Inventors: Toshi Maruyama, Jyoyo; Masami Takine, Kyoto, both of Japan

[73] Assignee: Tetra Pak International AB, Lund, Sweden

[21] Appl. No.: 168,680

[22] Filed: Jul. 11, 1980

[30] Foreign Application Priority Data

Jul. 11, 1979 [JP] Japan ..... 54-88521

[51] Int. Cl.[3] ..... B65B 47/04

[52] U.S. Cl. ..... 53/553; 53/559

[58] Field of Search ..... 53/559, 560, 591, 586, 53/579, 553, 234, 236, 225

[56] References Cited

U.S. PATENT DOCUMENTS

| | | | |
|---|---|---|---|
| 2,826,020 | 3/1958 | Hoag | 53/560 X |
| 3,038,282 | 6/1962 | Hansen et al. | 53/560 X |
| 3,353,329 | 11/1967 | Cloud et al. | 53/559 X |
| 3,732,663 | 5/1973 | Geldmacher | 53/236 X |
| 3,759,011 | 9/1973 | Akke | 53/559 |
| 3,846,956 | 11/1974 | Johnson | 53/559 X |
| 3,871,155 | 3/1975 | Blaser | 53/559 X |
| 4,017,247 | 4/1977 | Soukup et al. | 53/559 X |

*Primary Examiner*—Horace M. Culver

*Attorney, Agent, or Firm*—Burns, Doane, Swecker & Mathis

[57] ABSTRACT

A machine for the production of a web with individually wrapped drinking straws from two separate plastic films is disclosed. The machine includes a rotatable drum around which one of the plastic films is led and simultaneously given a corrugated form. The drinking straws are thereafter placed one by one in the recesses in the corrugated form and the second plastic film is applied and heat-sealed to said corrugated first film so that the drinking straws are completely enclosed in air-tight packages.

5 Claims, 18 Drawing Figures

MACHINE FOR WRAPPING ELONGATED ARTICLES IN PLASTIC FILM

BACKGROUND AND SUMMARY OF THE INVENTION

The present invention relates to a machine for wrapping elongated articles in plastic film.

A commonly used packing container of paper and plastic for packaging fruit juice, milk and other liquid products is often provided with a drinking straw attached to the side of the container, and the straw is generally wrapped in a cover for sanitary reasons.

The present invention relates to a machine in which an elongated article such as a drinking straw may be enclosed or wrapped in a sanitary cover in an automatic and effecient manner by using two web-shaped plastic films.

BRIEF DESCRIPTION OF THE DRAWINGS

The following description of an embodiment of the machine accordance with the present invention will be made with reference to the enclosed drawings, wherein like members bear like reference numerals and werein.

DETAILED DESCRIPTION OF THE PREFERRED EMBODIMENT

Figure 1:
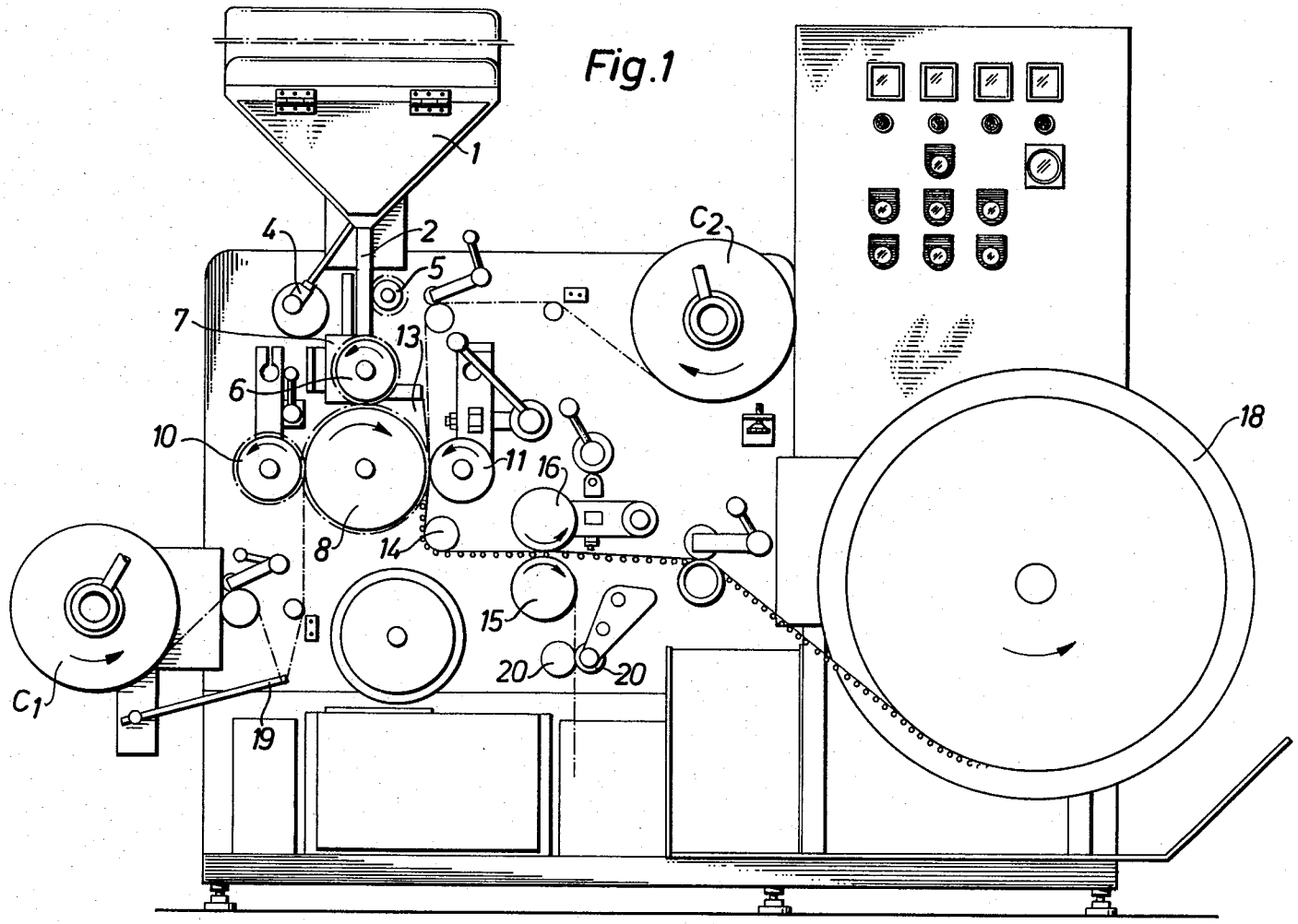
FIG. 1 is a general sideview of a machine in accordance with the present invention.

With reference to FIG. 1, a number of elongated articles such as drinking straws are contained in a hopper 1 having a V-shaped section. Said drinking straws are adapted to fall down by the gravity force one by one in a vertical passage 2 communicating with the outlet of the hopper.

Figure 2:
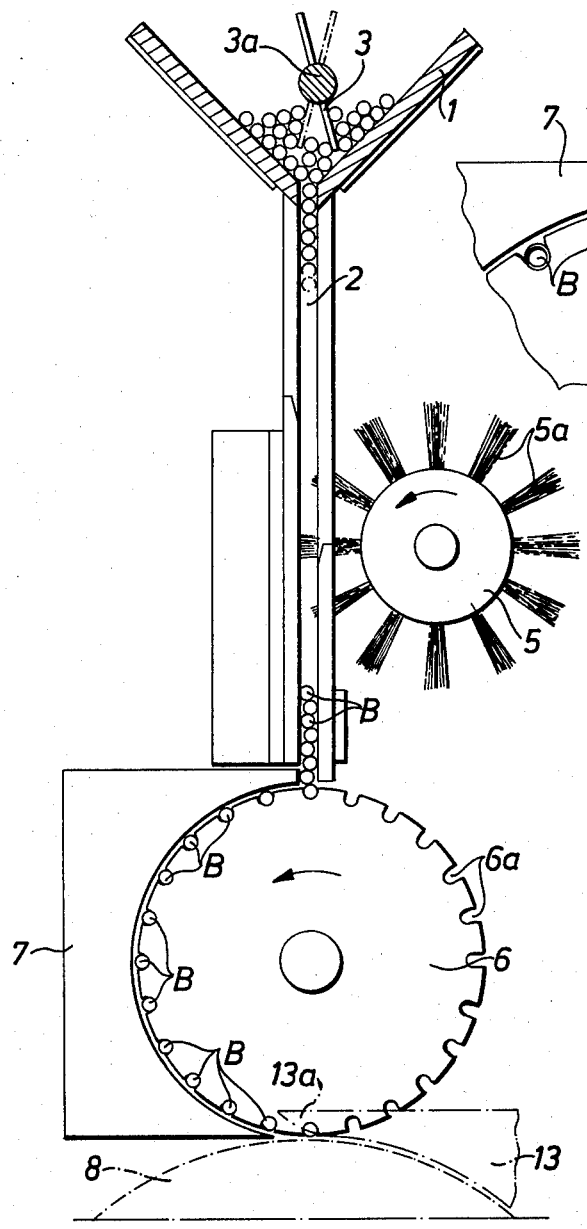
FIGS. 2 and 4 are enlarged portions of the machine of FIG. 1, FIGS. 3 and 5 are enlarged frontviews of the main portions as in FIGS. 2 and 4.
Figure 3:
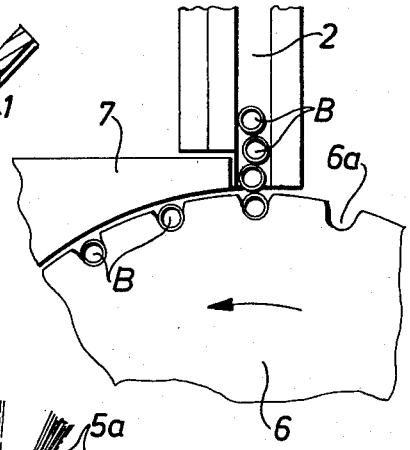

The hopper 1 is provided with movable blades 3 adapted to be swung around a shaft 3*a* in a reciprocating movement, whereby the movement is limited to a predetermined range by means of a mechanism 4, in such a way that the blades 3 are moved within the range defined by a solid line and a dotted line (FIG. 2). The movement of the blades 3 will permit the drinking straws B to fall down one by one in the passage 2. Approx. at the middle of the passage 2 a rotatable member 5 provided with a plurality of brushes 5*a* is located. Said brushes 5*a* will pass through the channel 2, and when the member 5 is rotated at high speed the brushes will force each drinking straw B to the end of the channel. Such a rotatable member 5 is very efficient, especially when the elongated articles fed through the channel 2 are light-weight drinking straws B.

A rotatable member 6 is located below the passage 2 and said member 6 is provided with a plurality of grooves 6*a* arranged at regular intervals around the periphery of the member 6. The drinking straws B fall down through the passage 2 and collected one by one in each of the grooves 6*a*. A guide surface 7 is arranged near the outside of the rotatable member 6 (at the left hand in FIGS. 1 and 2), in such a way that it will cover a part of the rotatable member 6. Thus, the guide 7 prevents the straws B received in and conveyed by the grooves 6*a* from falling out from the grooves during the transportation. A rotatable member 8 which is located below the rotatable member 6 is provided with a plurality of grooves 8*a* at regular intervals in the same manner as the rotatable member 6.

Between the grooves 8*a* pressure pads 8*b* are embedded along the periphery of the rotatable member 8. Those pressure pads 8*b* are adapted to be brought into contact with the peripheral surface of a heater drum 11, which is discussed later.

The rotatable member 8 is furthermore provided with a plurality of holes 8*c* (FIGS. 6 and 8) which are passing through the rotatable member 8 in an axial direction. Each of the said grooves 8*a* is provided with a hole 8*c* which extend in an axial direction from one end of the rotatable member 8 and end near the opposite end surface of the rotatable member 8. Said holes 8*c* are consequently not passing through the rotatable member 8 but will form a "dead end channel" which is connected with its groove 8*a* by means of a plurality of radially arranged channels 8*d*.

Figure 4:
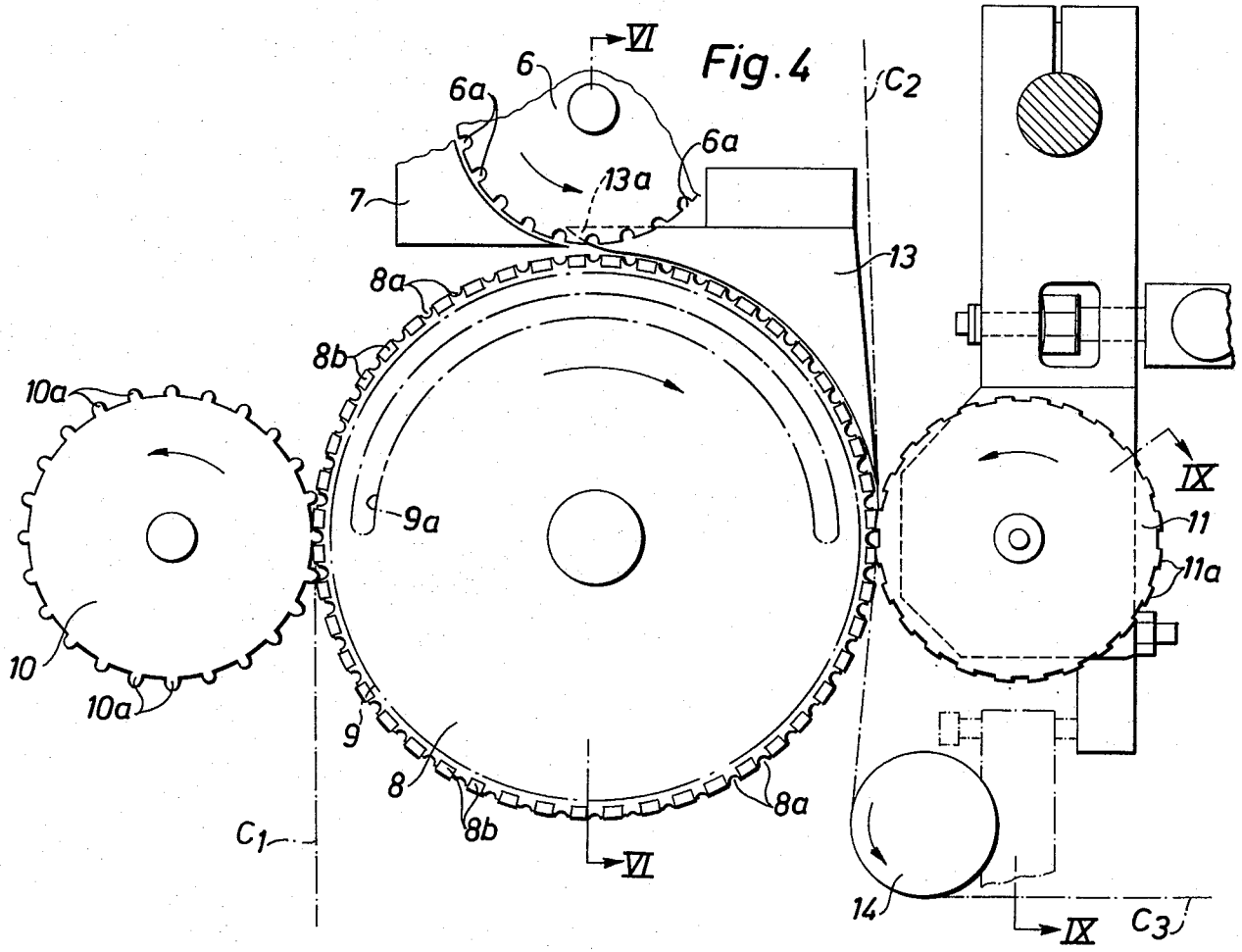
Figure 6:
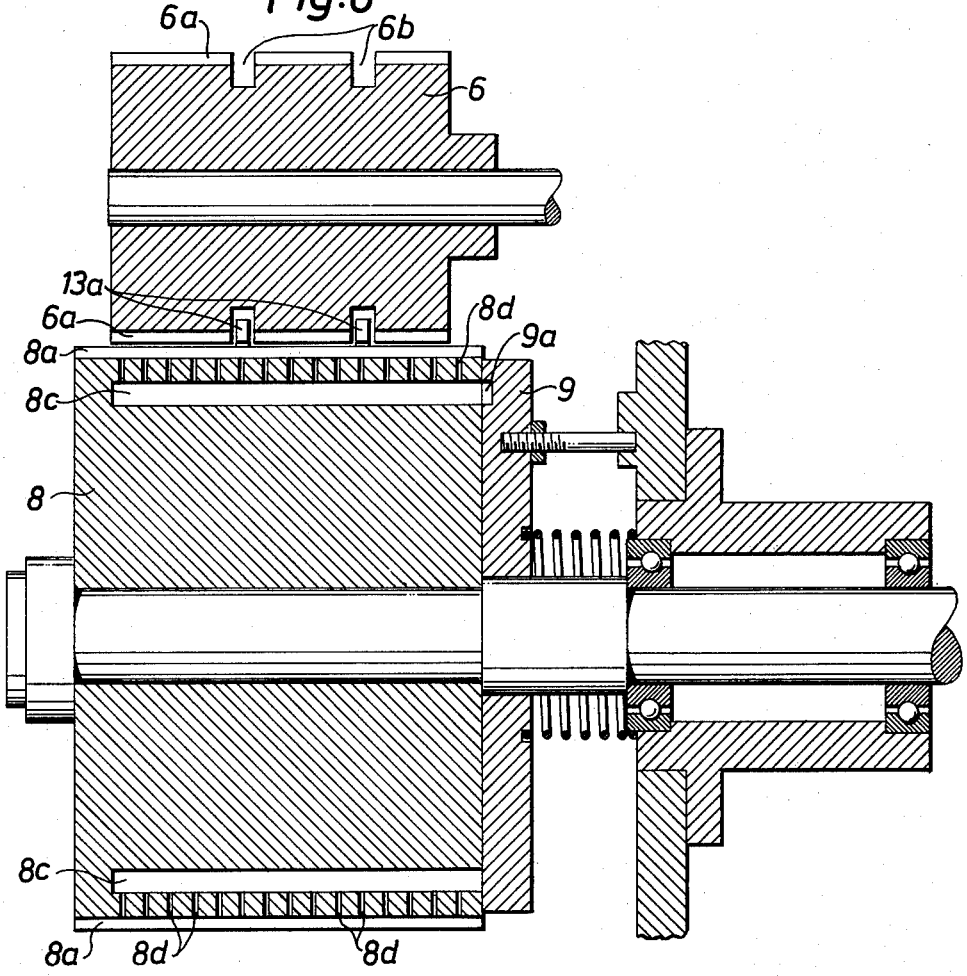
FIG. 6 is a sectional view taken along the section line VI—VI in FIG. 4.
Figure 7:
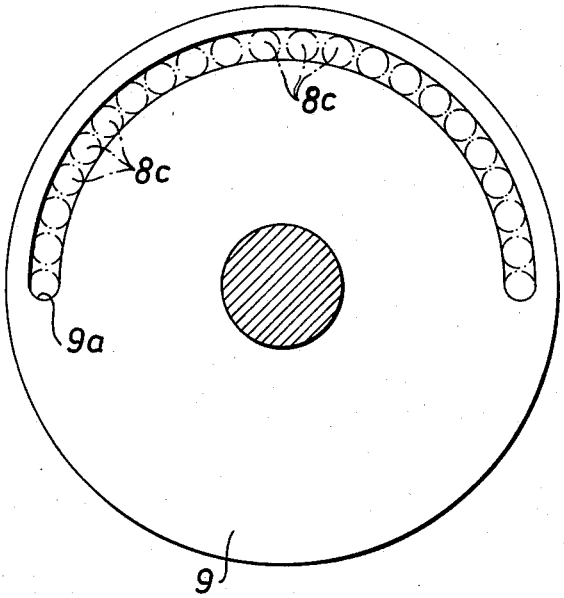
FIG. 7 is a front view of a fixed disc used in the present invention.

The side of the rotatable member 8 provided with the openings of the holes 8*c* is always in contact with a fixed disc 9. This disc 9 is provided with a front surface (the left hand surface in FIG. 6) with a groove 9*a* forming a semi-circle at the position corresponding to the openings of the holes 8*c* in the rotatable member 8 (FIGS. 4 and 7). The groove 9*a* is designed in such a way that its deepest section is located at the starting end of the groove 9*a* (at the left end in FIG. 7). The deep of the groove 9*a* will then shallow towards the terminal end thereof. The groove 9*a* is connected to a vacuum source (not shown) so that a suction force is adapted to exert onto the grooves 8*a* through the grooves 9*a*, the holes 8*c* and the channels 8*d*.

In accordance with the arrangement described the greatest suction force is applied at the starting end of the groove 9*a* where the groove has its largest depth, which means that the greatest suction force will exert on the suction 8*a* located at the position corresponding to the starting end of the grooves 9*a*. The grooves 8*a* will be subjected to a weaker suction force as the force reaches the terminal end of the groove 9*a* by the rotation of the rotatable member 8. No suction force is exerted onto the grooves 8*a* at the position of the disc 9 where the groove 9*a* is not formed.

A drum 10 for pushing a film $C^1$ into the groove 8*a* is arranged adjacent to the rotatable member 8, and the heater drum 11 is adjacently arranged at the side opposite the drum in relation to the rotatable member 8 (FIG. 4).

The drum 10 is provided at the periphery thereof with a plurality of projecting members 10*a* at regular intervals. Said members are adapted to engage with the grooves 8*a* in the rotatable member 8.

The film $C^1$ which is rolled onto a storage roll, is adapted to be fed in between the rotatable member 8 and the drum 10 and to be continuously pressed down in the grooves 8*a*. When the film $C^1$ is pushed or pressed into the grooves 8*a* by the projecting members 10*a* the film is held against the inner surface of the grooves 8*a* by the suction force exerted on the grooves 8*a*. Here it is to be noted that the film $C^1$ is stretched over the pressure pads 8*b* owing to the fact that the parts of the film which are pressed into the grooves 8*a* are kept in position by the suction force.

Figure 9:
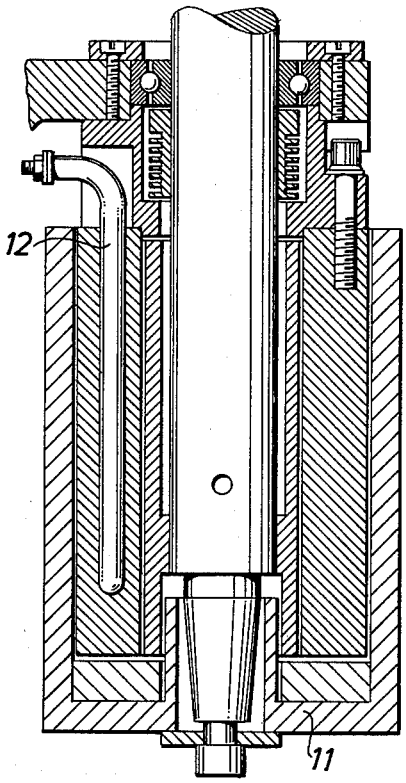
FIG. 9 is a section view taken along the section line IV—IV in FIG. 4.
Figure 11:
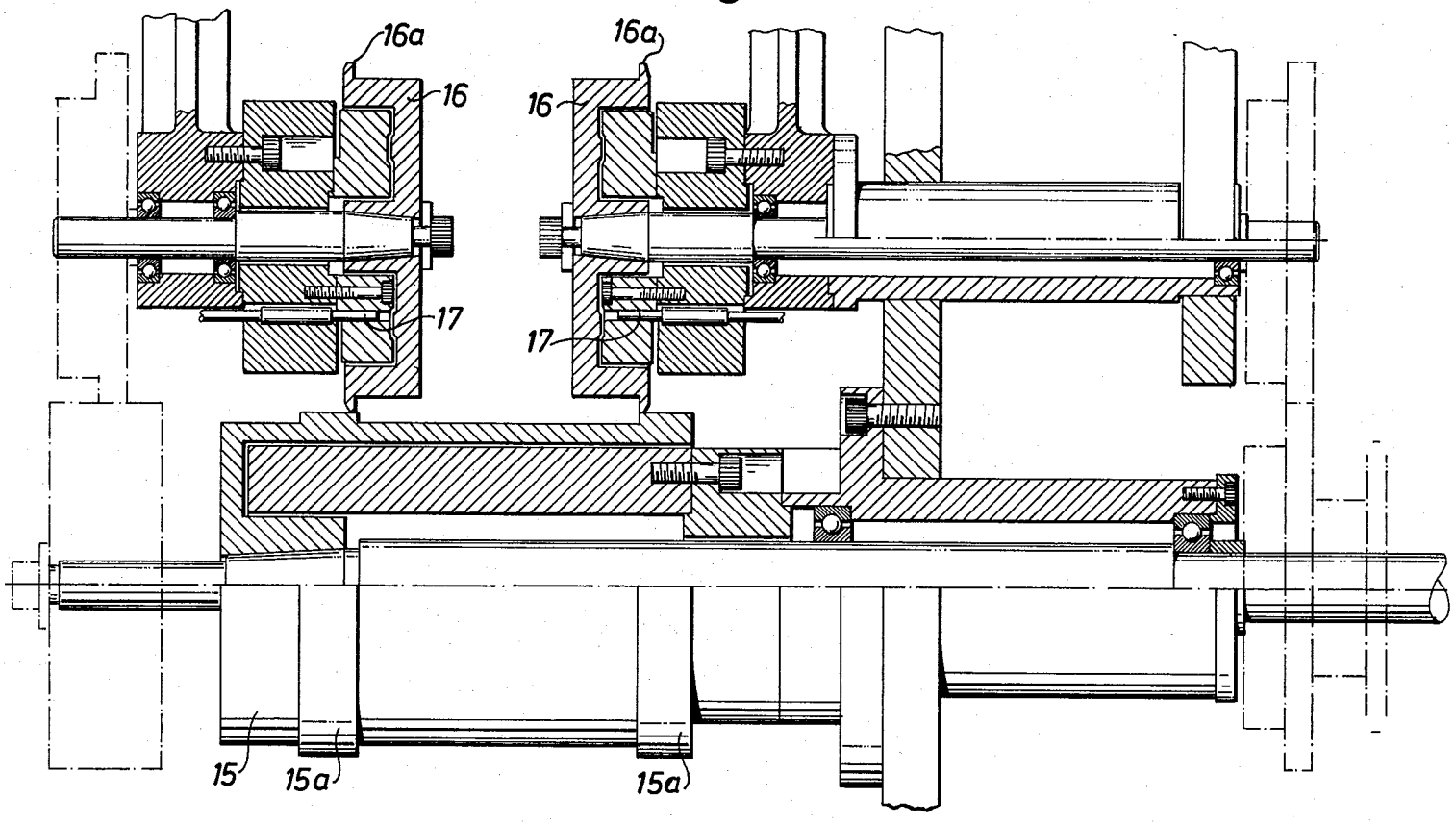
FIG. 11 is an enlarged longitudinal section view of FIG. 10, FIGS. 12–15 are enlarged views illustrating the process of wrapping the drinking straws.

The heater drum 11 is provided at the periphery thereof with a plurality of projections 11*a* at regular intervals, and such projections 11*a* are adapted to come into contact with the pressure pads 8*b*. This heater drum 11 is arranged for heat-welding the film $C^1$ to another film $C^2$ in a welding area along the drum 11. With reference to FIG. 9 the heater drum is rotated at the outside of a fixed heater 12 and is heated by radiant heat from the heater 12. At the outside of the periphery of the rotatable member 8 two guiding bars are arranged between the rotatable member 6 and the heater drum 11 in order to cover a part of the periphery of the rotatable member 8. With reference to FIG. 6 one end 13*a* of these guiding bars 13 is arranged in peripheral grooves 6*b* formed along the periphery of the rotatable member 6. A roller 14 is arranged below the heater drum 11 (FIGS. 1 and 4 ) and after this roller (at the right hand in FIG. 1) a sealing device for a longitudinal seam is arranged. With reference to FIG. 11 this sealing device comprises one lower rotatable member 15 and two upper heater drums 16.

The rotatable member 15 is provided with peripheral projecting portions 15*a* adapted to co-operate with the heater drum. Said peripheral projecting portions 15*a* are arranged so as to come into contact with peripheral projecting portions 16*a* disposed around the periphery of the heater drum 16. By such contact the films $C^1$ and $C_2$ which are brought in between said rotatable member 15 and said heater drum 16 will be heat-welded and "melt cut". In the same way as the heater drum 11 the heater drums 16 are rotated along fixed heaters 17 and adapted to be heated by radiant heat from the fixed heaters 17.

Provisions are made so that all of the rotatable members 6 and 8, the drum 10, the heater drum 11, the rotatable member 15 and the heater drum 16 will be rotated in a synchronous manner with each other.

With further reference to FIG. 1 further elements are arranged, e.g. a take-up 18, tension means 19 by means of which the film $C^1$ may be fed under strain, and a take-up roll for taking up the sealed edges D.

The films $C^1$ and $C^2$ to be used for packing of elongated articles B such as drinking straws according to the present invention, have a width which is larger than the length of such drinking straws B.

Figure 8:
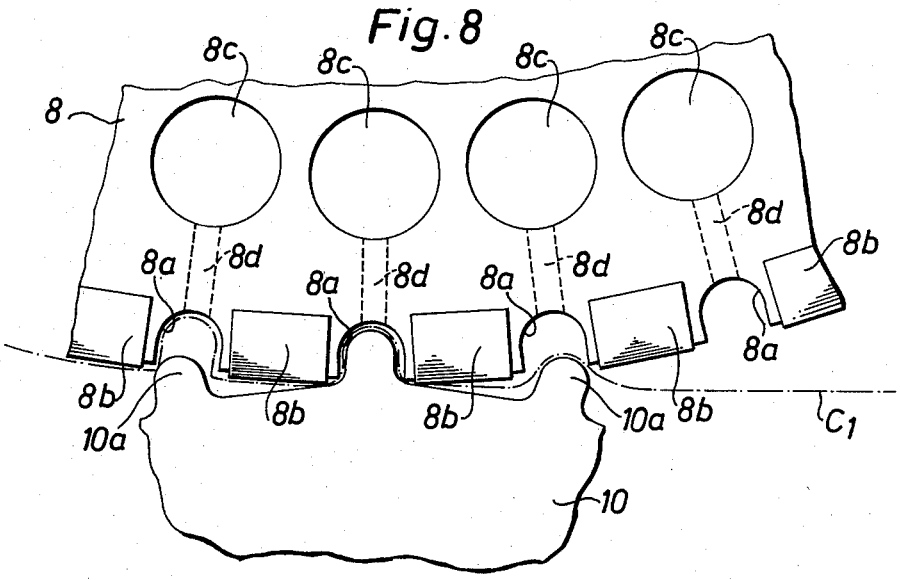
FIG. 8 is an enlarged view illustrating how the film is arranged along the periphery of a rotatable member.
Figure 10:
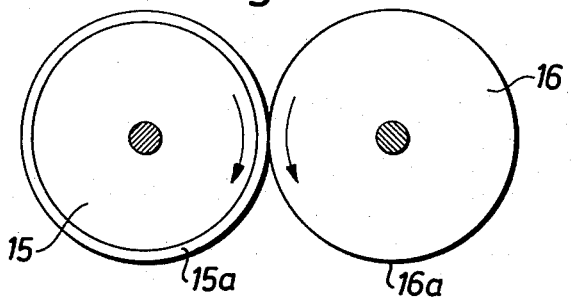
FIG. 10 is a front view illustrating the sealing operation.

While the films $C^1$ and $C^2$ are continuously fed from storage rolls the film $C^1$ will be formed and held by and between the rotatable member 8 and the drum 10 and continuously wound onto the periphery of the rotatable member 8. At this time portions of the film $C^1$ are pushed into the grooves 8*a* of the rotatable member 8 by the projecting members 10*a* of the drum 10, and stick to the inner surfaces of the grooves 8*a* due to the suction force exerted onto such grooves 8*a* by suction means (not shown), as shown in FIG. 8. Thus the rotatable member 8 goes on rotating during a continuous forming of the film $C^1$.

On the other hand the straws B are fed one by one from the hopper 1 to the passage 2. When the straws have fallen down through the passage 2 the straws B are received, also one by one, in the grooves 6*a* arranged in the rotating member 6, which member is located below the passage 2 and rotated counter-clockwise (FIGS. 1 and 2).

Figure 5:
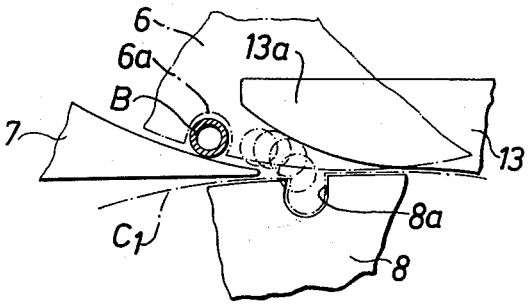

The straws are kept in the grooves 6*a* by a guiding member 7, which guiding member is covering about 180° of the periphery of the member 6. At the lowermost end of the rotating member 6, where the support by the guiding member 7 no longer exists, the straws are removed from the grooves 6*a* in a downward direction by the front end 13*a* of a guide bar 13 in the way indicated by dotted lines in FIG. 5, and the straws are subsequently transferred into the grooves 8*a* in the rotatable member 8 arranged just below the rotatable member 6.

Figure 12:
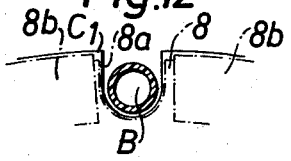
Figure 14:
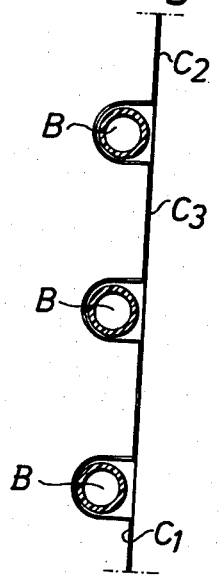

As the film $C^1$ already has been arranged around the rotatable member 8 and is pushed down into the grooves 8*a* the straws B will be embedded in the film $C^1$ and covered by the film with the exception the topside of the straws (FIG. 12). After being pushed into the grooves 8*a* the straws B are conveyed to the position opposite the heater drum 11 by the rotatable member 8. Here, it is to be noted that during the rotation of the rotatable member 8 the straws B will not fall out from the grooves 8*a* as Straw B are kept in place by the guide member 13.

Figure 13:
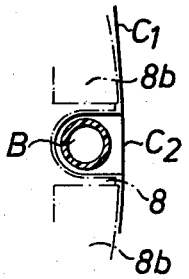
Figure 15:
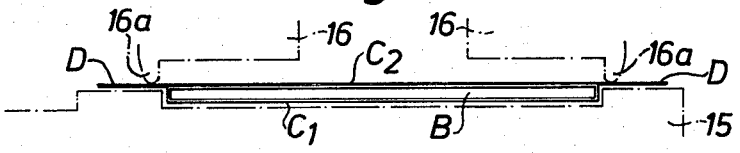

The film $C^2$ is fed between the rotatable member 9 and the heater drum 11 and as shown in FIG. 13 the film $C^2$ covers those portions of the straws B which have not been covered by the film $C^1$. Thus the straws B are now wholly enclosed between the films $C^1$ and $C^2$.

Figure 16:
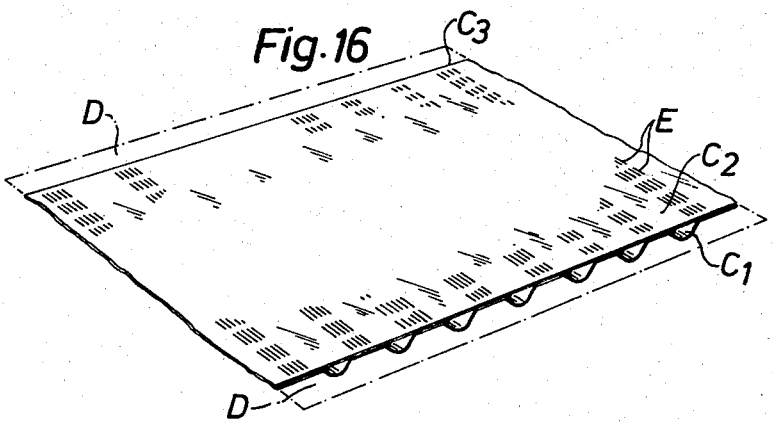
FIG. 16 is a perspective view illustrating a band enclosing drinking straws arranged in parallel relationship at predetermined distances from each other.
Figure 17:
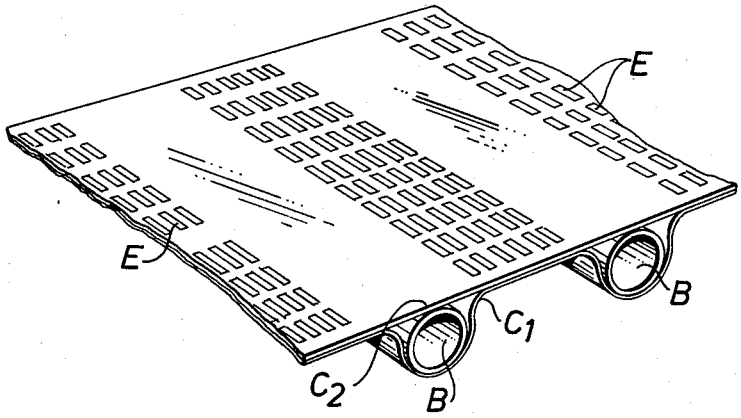
FIG. 17 is an enlarged perspective view of the main portion of FIG. 16, which portion is shown in section.
Figure 18:
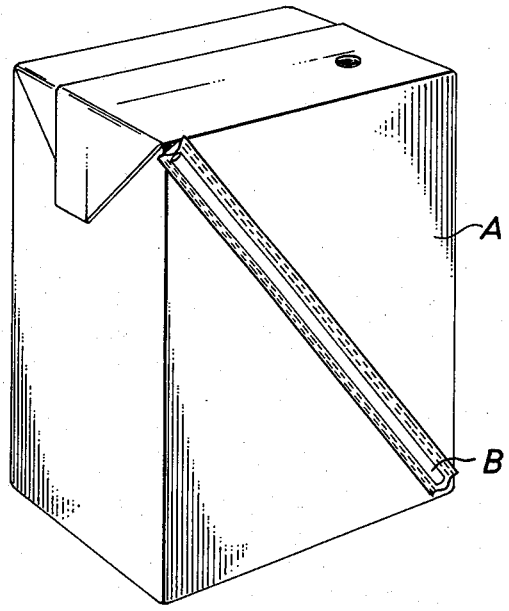
FIG. 18 is a perspective view of a packing container provided with a wrapped drinking straw produced with the machine in accordance with the invention.

The contact between the pressure pads 8*b* of the rotatable member 8 and the projections 11*a* of the heater drum 11 cause the films $C^1$ and $C^2$ to be welded together with each other along the contact zones E transverse to the longitudinal directions of the films $C^1$ and $C^2$ (FIGS. 16 and 17).

In order to reinforce the sealing portions E the said projections 11*a* and the pressure pads 8*b* can be provided with discontinuities which will form grooves or indentations in the sealed zone E.

The formed band $C^3$ containing the straws is then conveyed between the rotatable member 15 and the heater drum 16 over a roller 14. By means of the contact between the projecting portions 16*a* of the heater drum 16 and the peripheral projecting surfaces 15*a* the two lengthwise edges of the band $C^3$ are melt-welded and at the same time edge portions D are cut and removed from the band $C^3$.

Thus the straws B are completely packed and enclosed between the two films $C^1$ and $C^2$. As the process described is repeated the packing band $C^3$ containing the straws B will be continuously produced with the straws arranged at regular intervals, and the said band $C^3$ is then continuously wound on a drum 18. The band $C^3$ containing the straws can then be cut in the sealed portions E to provide a package in which one single straw is packed. Such cutting may be performed in an automatic manner by using a cutting machine.

The waste material from the edges D, which is in a band-shape may be removed and rolled in a take-up roll 20.

According to the present invention packaging of elongated articles such as drinking straws with the help of two films may be performed in an automatic and very efficient manner. The use of band-shaped films will make it possible to produce a band-shaped package, in which the drinking straws are packed in a continuous manner in an efficient way.

The principles and preferred embodiment of the present invention have been described in the foregoing specification. However, the invention which is intended to be protected is not to be construed as limited to the particular embodiment disclosed. The embodiment is to be regarded as illustrated rather than restrictive. Variations and changes may be made by others without departing from the spirit of the invention. Accordingly, it is expressly intended that all such variations and changes which fall within the spirit and scope of the present invention as defined in the appended claims be embraced thereby.

What is claimed is:

1. An apparatus for wrapping elongated articles in plastic film, comprising means for individually passing said elongated articles sideways in a channel, a first rotatable member having on the periphery thereof grooves each formed such that said elongated articles will fit therein, a second rotatable member provided with axially directed grooves along its periphery, said second rotatable member being located between said channel and said first rotatable member, said second member being immediately below an outlet of said channel which is aligned with said grooves of the second rotatable member, said second rotatable member being adapted to transfer the elongated articles from the outlet of said channel to the grooves arranged along the periphery of said first rotatable member, means for arranging a first plastic film in close contact with both the periphery and the grooves of the first rotatable member, means for applying a second plastic film over said first film and over said grooves, a first heater drum adapted for sealing said second plastic film to said first plastic film along selected transverse zones between said elongated articles, and a second heater drum for subsequently sealing longitudinal edges of said second plastic film to longitudinal edges of said first plastic film whereby said elongated articles are individually sealed between said first and second plastic films.

2. The apparatus in accordance with claim 1, wherein said means for arranging the first plastic film comprises a rotatable drum provided with elements protruding from the peripheral surface of the drum in the radial direction of said drum, said protruding elements having substantially the same shape and size as said grooves in the first rotatable member and being adapted to push said first film into said grooves in the first rotatable member such that the first film will be arranged in close contact with both the periphery and the grooves of said first rotatable member.

3. The apparatus in accordance with claim 1, further comprising guiding bars arranged along a portion of the outer peripheral surface of the first rotatable member between the location at which the elongated articles are transferred to the first member and the first heater drum for maintaining the elongated articles within the grooves in the first rotatable member.

4. The apparatus in accordance with claim 1, further comprising a guiding member arranged along a portion of the outer peripheral surface of the second rotatable member between the channel outlet and the first rotatable member for maintaining the elongated articles within the grooves in the second rotatable member.

5. The apparatus in accordance with claim 1, wherein each of the grooves in the first rotatable member is connected to a vacuum source.

* * * * *